US005449295A

United States Patent [19]

Hanano et al.

[11] Patent Number: 5,449,295

[45] Date of Patent: Sep. 12, 1995

[54] AUTOMATIC ELECTRIC COUPLING MECHANISM FOR A PASSENGER TRANSIT TYPE VEHICLE

[75] Inventors: M. Nihad Hanano, Greer; Conley L. McGee, Simpsonville, both of S.C.

[73] Assignee: Westinghouse Air Brake Company, Wilmerding, Pa.

[21] Appl. No.: 233,267

[22] Filed: Apr. 26, 1994

[51] Int. Cl.[6] ..... H01R 13/60

[52] U.S. Cl. ..... 439/310; 439/34

[58] Field of Search ..... 439/310, 287, 284, 345, 439/290, 289, 288, 34, 192, 194

[56] References Cited

U.S. PATENT DOCUMENTS

| | | | |
|---|---|---|---|
| 399,326 | 3/1889 | Griggs | 439/290 X |
| 3,868,909 | 3/1975 | Pelabon | 439/34 X |
| 3,895,850 | 7/1975 | Engle et al. | 439/34 OR |
| 4,343,522 | 8/1982 | O'Neil | 439/34 OR |
| 5,139,158 | 8/1992 | Lindner | 439/310 X |

*Primary Examiner*—Larry I. Schwartz
*Assistant Examiner*—Daniel Wittels
*Attorney, Agent, or Firm*—James O. Ray, Jr.

[57] ABSTRACT

An electric coupler engages a mechanical coupler disposed on a passenger transit vehicle to enable necessary electrical connections required to operate such vehicle to be achieved. Such electric coupler includes an interface device engaging both such mechanical coupler and such electric coupler for positioning the electric coupler on such mechanical coupler. A first securing device engages each of such interface device and such mechanical coupler for securing them together. A second securing device engages each of such interface device and such electric coupler for securing them together. A pair of bearing shaft members and a pair of shaft support members connected to a respective one of such pair of bearing shaft members are provided. A third securing device engages each of such interface device and such pair of shaft support members for securing them together. A pair of electric coupler box members and a pair of linear bearings are provided. A respective one of such pair of linear bearings is secured to a portion of a respective one of such electric coupler box members and engage a respective one of such bearing shaft members. A thrust plate member is disposed on such linear bearing electric coupler assembly. A pair of coil springs are connected to support such thrust plate for longitudinal movement. A connection device engages such electric coupler box members and such coil springs for connecting them together. A thrust mechanism is connected to the thrust plate for applying a thrust force thereto during coupling and uncoupling operations.

20 Claims, 3 Drawing Sheets

AUTOMATIC ELECTRIC COUPLING MECHANISM FOR A PASSENGER TRANSIT TYPE VEHICLE

FIELD OF THE INVENTION

The present invention relates, in general, to what is known in the art as an automatic type electric coupling assembly which is used to electrically couple together the adjacently disposed ends of a pair of railway cars and/or similar type vehicles used in the passenger transit industry incident to such adjacently disposed ends being mechanically coupled together with a mechanical type coupling mechanism and, more particularly, this invention relates to an improved movable type electric coupler box member that is guided in a precise and particular manner such that substantially any undesirable and/or detrimental movement of such electric coupler box member which is generally caused during the operation of a train consist by at least one of vibration, shock, and/or inertia transmitted by train dynamics will be essentially eliminated.

BACKGROUND OF THE INVENTION

Prior to the present invention, as is generally quite well known in the railway car coupling art, passenger transit type railway cars have generally been equipped to enable an automatic coupling of the electric train lines disposed on such railway cars to be accomplished. The electric coupling equipment, used to accomplish the task of automatically coupling these electric train lines, has normally been disposed either on the top portion, or on the bottom portion, or on the side portions of the mechanical type coupler mechanism.

The electrical contacts which are required for connecting such electric train lines together are, as a general rule, disposed within an electric coupling box member. Such electric coupling box is disposed on the mechanical type coupling mechanism in a position to, first, allow movement in a forward direction upon completion of the mechanical coupling operation of the adjacently disposed ends of the railway cars and, secondly, to allow movement in a reverse direction when a mechanical uncoupling operation of such railway cars is required.

In this known fashion, the necessary electrical connection is accomplished with an adjacently disposed car, thereby enabling the completion of the necessary electrical circuits. On the other hand, the electric coupler box member is designed to be retracted in an axially opposed backward direction upon the receipt therein of an uncoupling command input signal and prior to allowing the mechanical uncoupling of such adjacently disposed ends of the railway cars to be accomplished.

The physical movements which such electric coupler box member is required to make have been accomplished, prior to the development of the present invention, by the suspension of such electric coupler box member on a guide means. Such guide means is normally attached, in a first method known to applicants, to the mechanical type coupling mechanism. This prior art attachment method makes use of guide wheels which are disposed on the electric coupler box member.

In a second method, also, known by the applicants to be used prior to the development of the present invention for achieving the required physical movements of such electric coupler box member, such electric coupler box member was designed in a manner which enabled it to slide in a longitudinal direction on a machined surface which is equipped with side guides.

However, both of the above described prior art type methods will inherently require extremely close design tolerances to be incorporated therein. As would be expected, such extremely close design tolerances have added significantly to the manufacturing cost for such electric coupling box members. Additionally, these extremely close design tolerances have been found to still allow unacceptably excessive frictional wear to occur to a significant number of certain critical railway car components. Such critical components at least include the electric contacts located in the electric coupler box members, wheels, machined surfaces and side guides.

SUMMARY OF THE INVENTION

In a first aspect, the present invention provides an improved electric coupling type mechanism which is designed to be engageable with a mechanical type coupling mechanism disposed on one end of a passenger transit type railway vehicle. Such electric coupling type mechanism will enable the necessary electrical connections to be achieved when one end of a first vehicle is being connected to an adjacently disposed end of a second vehicle. This electric coupling type mechanism includes an interface means which is engageable with both such mechanical type coupling mechanism and such electric coupling type mechanism. This interface means provides a way of positioning, in a first predetermined position, such electric coupling type mechanism with respect to the mechanical type coupling mechanism. A first securing means is engageable with each of such interface means and the mechanical type coupling mechanism for securing such interface means to the mechanical type coupling mechanism. There is a second securing means engageable with each of such interface means and the electric coupling type mechanism for securing such electric coupling type mechanism to the interface means. The electric coupling type mechanism further includes a pair of bearing shaft members. A pair of shaft support members are connected to a respective one of such pair of bearing shaft members. Additionally, there is a third securing means engageable with each of such interface means and such pair of shaft support members which secure the pair of shaft support members to such interface means in a second predetermined position. A pair of electric coupler box members are provided as well as a pair of linear type bearings. A respective one of such pair of linear type bearings being secured to a predetermined portion of a respective one of such electric box members. In addition,respective ones of the pair of linear type bearings are engageable with respective ones of such bearing shaft members. A thrust plate member is disposed on such linear bearing type electric coupler assembly. Connected to support this thrust plate member for movement in a longitudinal direction is a pair of coil springs. A means is positioned to engage both the electric coupler box members and such coil springs for connecting such coil springs to the electric coupler box member. The last essential element of the linear bearing type electric coupler assembly is a thrust mechanism which is connected to such thrust plate member for applying a predetermined thrust force to such thrust plate member during at least one of a coupling operation and an uncoupling operation.

In a second aspect, the instant invention provides a coupling mechanism for connecting adjacently disposed ends of a pair of passenger transit type vehicles together to form a train consist. Such passenger transit type vehicle coupling mechanism includes a mechanical type coupling mechanism secured to one end of such passenger transit type vehicle and a linear bearing type electric coupling mechanism. This linear bearing type electric coupling mechanism will generally be the same as described above with respect to the first embodiment of the invention. Therefore, for the sake of brevity, the description will not be repeated here.

OBJECTS OF THE INVENTION

It is, therefore, one of the primary objects of the present invention to provide a movable type electric coupler box, for use on a passenger transit type vehicle, which is guided in such a manner that will at least substantially minimize and/or eliminate any undesirable and detrimental movement of such movable electric coupler box which may either originate from or be caused by any one of excess vibration, shock, and/or inertia transmitted by train dynamics.

Another object of the present invention is to provide a movable type electric coupler box, for use on a passenger transit type vehicle, which is guided in such a fashion that will enable a substantially perfect alignment of adjacently disposed electrical contacts to be readily achieved without the use of guide pins and bushings.

Still another object of the present invention is to provide a movable type electric coupler box, for use on a passenger transit type vehicle, which will substantially minimize the frictional wear exhibited by the contact pins that will normally result from any undesirable movement of such electric coupler during coupled train operation.

Yet another object of the present invention is to provide a movable type electric coupler box, for use on a passenger transit type vehicle, in which such electric coupler box equipped with associated guides and support are attached to the mechanical coupler as an integral unit thereby providing a more simplified assembly.

A further object of the present invention is to provide a movable type electric coupler box, for use on a passenger transit type vehicle, in which there is provided a means to protect such electric coupler box in the event of an over adjustment occurring to the coupling position.

An additional object of the present invention is to provide a movable type electric coupler box, for use on a passenger transit type vehicle, which is relatively easy to install.

Still yet another object of the present invention is to provide a movable type electric coupler box, for use on a passenger transit type vehicle, which can be retrofitted to existing mechanical couplers.

Yet still another object of the present invention is to provide a movable electric coupler box, for use on a passenger transit type vehicle, which will require a minimum amount of maintenance.

A still further object of the present invention is to provide a movable type electric coupler box, for use on a passenger transit type vehicle, which is relatively inexpensive to manufacture when compared to prior art type electric coupler boxes.

In addition to the numerous objects and advantages of the present invention which have been described above, various other objects and advantages of the movable type electric coupler box will become more readily apparent to those persons who are skilled in the passenger transit type electric coupling art from the following more detailed description of the invention, particularly, when such description is taken in conjunction with the attached drawing Figures and with the appended claims.

BRIEF DESCRIPTION OF THE PRESENTLY PREFERRED EMBODIMENTS OF THE INVENTION

Figure 1:
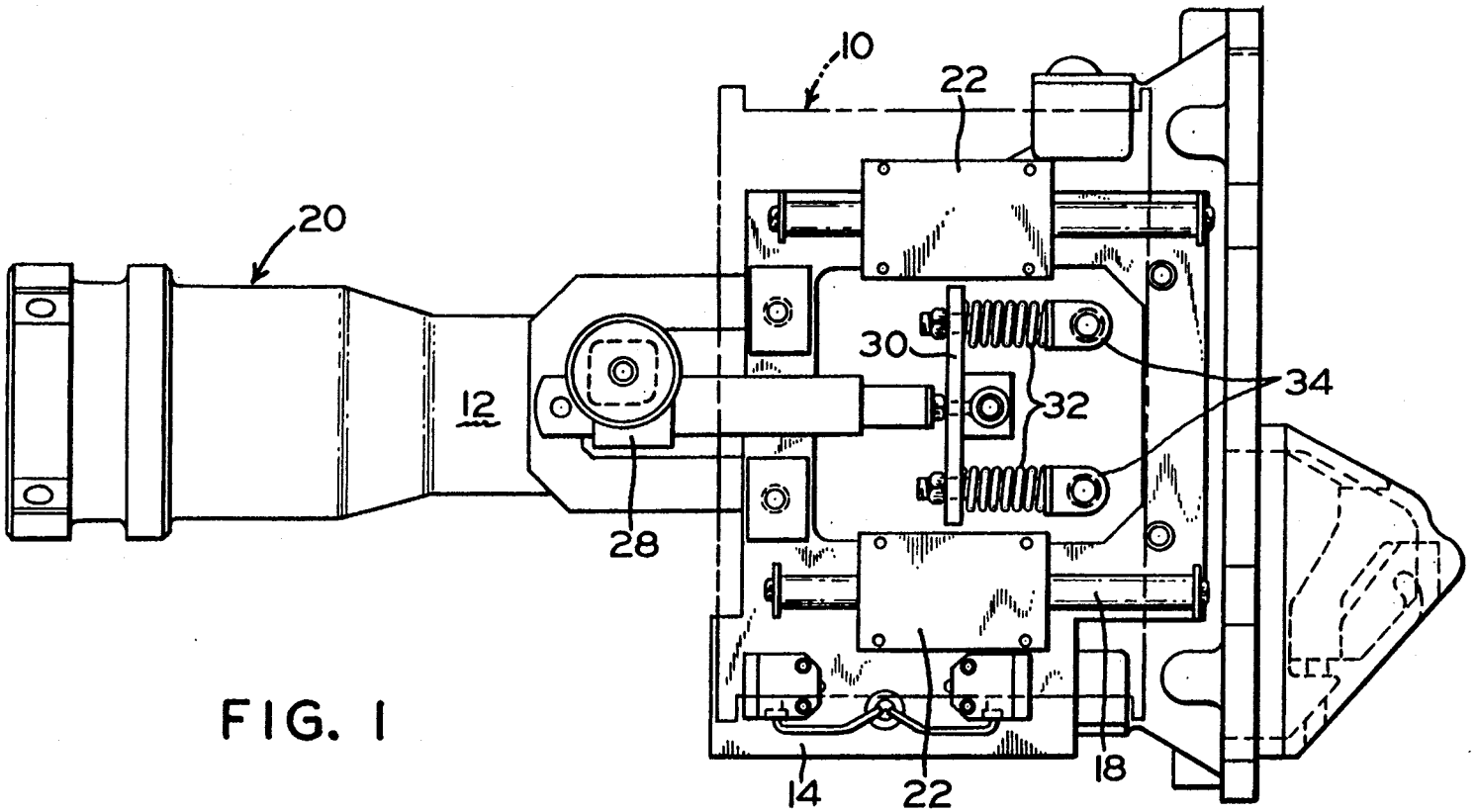
FIG. 1 is plan view of a typical installation, of a presently preferred embodiment, of a buffered linear bearing type electric coupler assembly which is shown connected to a mechanical type coupling mechanism and which is manufactured according to the present invention.

Prior to proceeding to the more detailed description of the automatic electric coupling mechanism for a passenger transit type vehicle according to the instant invention, it should be noted that, for the sake of clarity and understanding of the invention, identical components, which have identical functions, have been identified with identical reference numerals throughout the several views which have been illustrated in the drawings.

Figure 2:
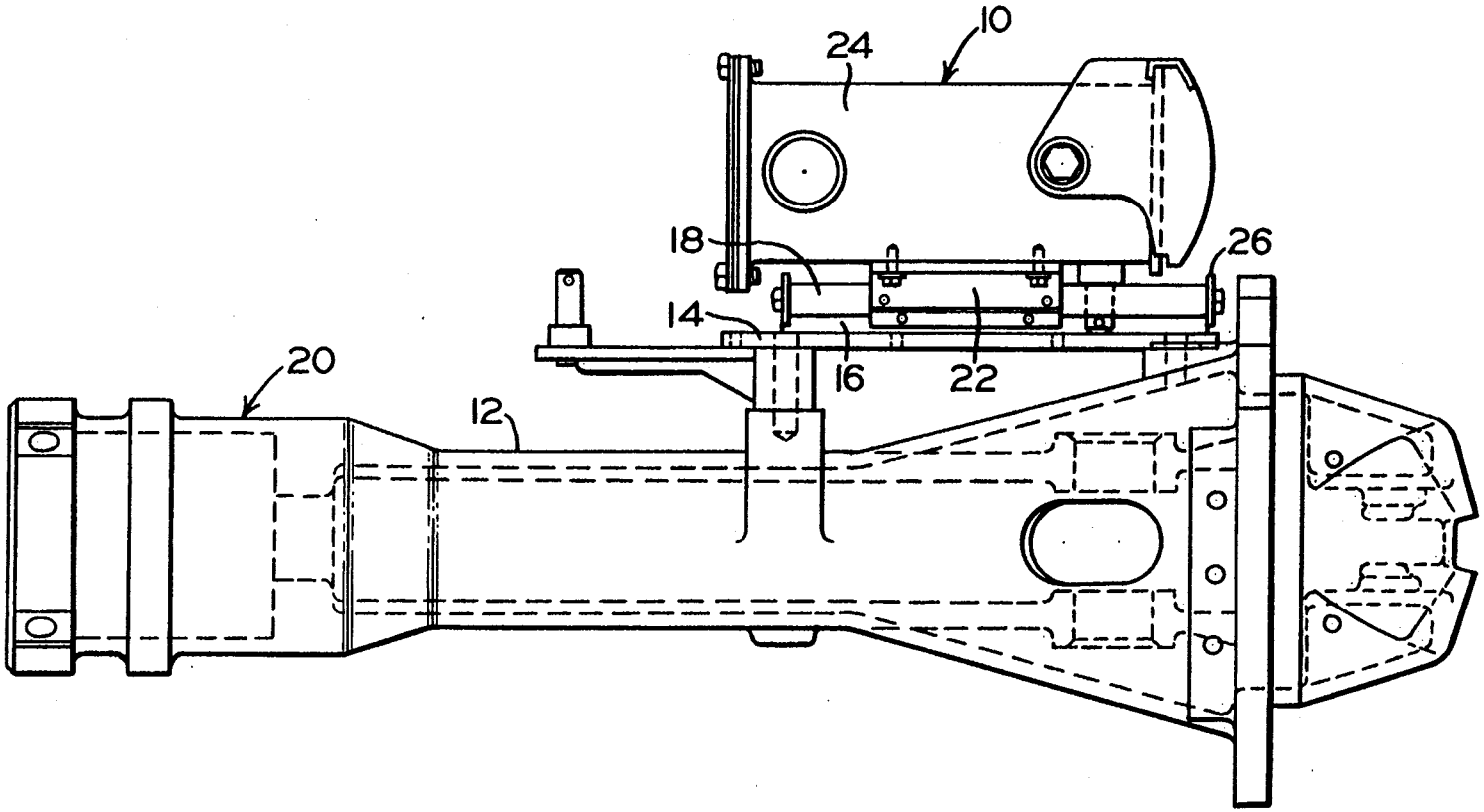
FIG. 2 is a side elevation view of the buffered linear bearing type electric coupler assembly illustrated in FIG. 1 which is also shown connected to the mechanical type coupling mechanism.
Figure 3:
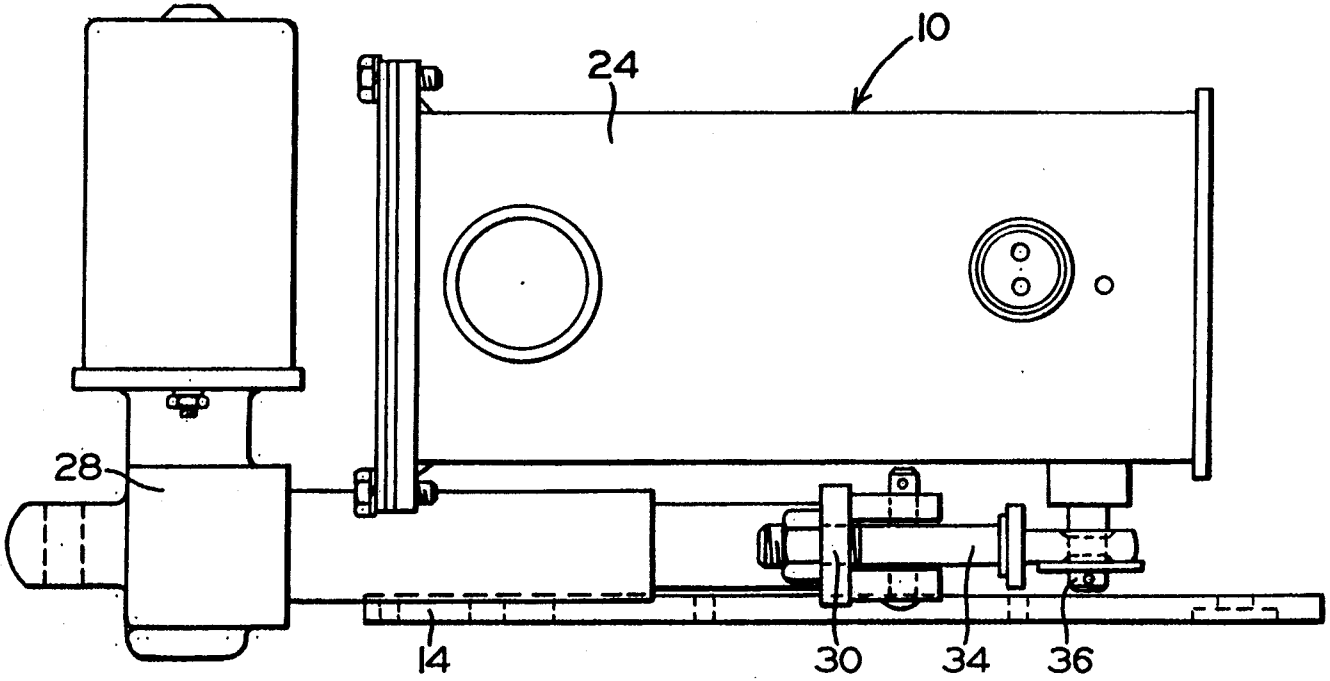
FIG. 3 is an enlarged side elevation view of the buffered linear bearing type electric coupler assembly illustrated in FIGS. 1 and 2.

Now reference is now made to the drawing Figures and in particular, to FIGS. 1 through 3. Illustrated therein is a presently preferred embodiment of a buffered linear bearing type electric coupler assembly, generally designated, 10. Such buffered linear bearing type electric coupler assembly 10 is removably connected to a mechanical type coupling mechanism, generally designated, 20.

The buffered linear bearing type electric coupler assembly 10 is positioned on the mechanical type coupling mechanism 20, which is attached to one end (not shown) of a passenger transit type railway car (not shown) and/or to one end of a similar type vehicle (not shown), to enable it to be matingly engaged with and securely locked to another buffered linear bearing type electric coupler assembly (not shown) positioned on another mechanical type coupling mechanism (not shown) which is, likewise, attached to one end of another adjacently disposed passenger transit type railway car (not shown).

As will be readily understood by those persons who are skilled in the passenger transit type railway car coupling art, depending upon the particular design configuration of the railway cars that will make up a train consist (not shown) in which such buffered linear bearing type electric coupler assembly 10 is to be utilized, the electric coupler assembly 10 can be attached to such mechanical type coupling mechanism 20 on the underneath portion thereof, or on the top portion thereof, or on one of the side portions thereof. Nevertheless, in most of the electric coupling type applications which are presently known to applicants, such electric coupler assembly 10 will usually be attached to the underneath portion of such mechanical type coupling mechanism 20.

The buffered linear bearing type electric coupler assembly 10 has been illustrated in both FIGS. 1 and 2, however, as being mounted for a typical installation on the top portion 12 of such mechanical type coupling mechanism 20.

There is an interface means provided intermediate the electric coupler assembly 10 and the mechanical type coupling mechanism 20. Such interface means is shown in the drawings in the form of an electric coupler assembly 10 support plate member 14. Such support plate member 14 is secured to both the electric coupler assembly 10 and to the mechanical type coupling mechanism 20 in a predetermined position that will substantially insure a generally central positioning of such electric coupler assembly 10 with respect to the mechanical type coupling mechanism 20. In addition, in the presently preferred embodiment of the invention, the support plate member 14 serves as a base member for the buffered linear bearing type coupler assembly 10.

Preferably, such support plate member 14 will be secured in a removable manner to both such electric coupler assembly 10 and the mechanical type coupling mechanism 20 by both pinning and bolting. It is to be understood, however, that the present invention is not considered to be limited to this one particular type of securing means, but is only considered to be limited by the scope of the appended claims.

Buffered linear bearing type electric coupler assembly 10, according to the present invention, includes a pair of shaft support members 16 and a pair of bearing shaft members 18. Such shaft support members 16 and such bearing shaft members 18 are removably secured to such support plate member 14, preferably, by both pinning and bolting. Such shaft support members 16 and such bearing shaft members 18 are, preferably, secured in a manner such that they will be disposed substantially symmetrical on both sides of the center of such support plate member 14.

Electric coupler assembly 10 further includes a pair of linear type bearings assemblies 22 and an electric coupler box member 24. These linear type bearings assemblies 22 are mounted, preferably, on the bottom portion of such electric coupler box member 24. Such linear type bearings assemblies 22 are, preferably, positioned in a substantially symmetric manner with respect to the center line of the insulation block. Additionally, such linear type bearings assemblies 22 are geometrically consistent with the shaft support members 16 and the bearing shaft members 18. According to the presently preferred embodiment of the invention, such linear type bearings assemblies 22 will be inserted onto such bearing shaft members 18 with the electric coupler box member 24 being attached thereto.

As is clearly illustrated in FIG. 2, such electric coupler box members 24 are secured onto the span length of the bearing shaft members 18 by means of a pair of fender washer members 26. Such fender washer members 26 are positioned on each respective end of both of the bearing shaft members 18.

The presently preferred embodiment of the buffered linear bearing type electric coupler assembly 10, also, includes a thrust mechanism 28 which is connected to apply a predetermined thrust force to a thrust plate member 30. Such thrust plate member 30 is supported for reciprocal longitudinal movement on the electric coupler assembly 10 by a pair of buffer type coil springs 32 and pin members 34. The pin members 34, in turn, are attached to pin members 36. Such pin members 36 protrude from and form an integral part of such electric coupler box members 24, as can best be seen in FIG. 3.

As illustrated in FIG. 1, the thrust mechanism 28 will, preferably, be driven electrically. However, as will be understood by persons skilled in the art, it is also within the scope of the present invention for such thrust mechanism 28 to be driven by a number of other forms of power such as, for example, pneumatics or hydraulics.

In operation, of the automatic electric coupling mechanism 10 of the instant invention, when at least two passenger transit type railway vehicles are to be either electrically coupled together in order to form a train consist, or are to be electrically uncoupled from one another, an electric signal will be generated and inputted to the thrust mechanism 28 for activating it. The activation of such thrust mechanism 28, upon receipt of an appropriate electric signal, will initiate either a forward advancement of the electric coupler box members 24, which contain all of the necessary electrical contacts (not shown) therein, during a coupling operation, or such thrust mechanism 28 will initiate a backward retraction of such electric coupler box member 24 upon receipt of an electrical signal which indicates an uncoupling operation is required.

Movement in any one of the lateral direction, the vertical direction and/or any combination of these lateral and vertical movements will be substantially limited, in the presently preferred embodiment of the invention, to the specific design tolerances of both the linear type bearings assemblies 22 and the bearing shaft members 18. Typically, these specific design tolerances will be on the order of about 0.001 inch or less.

During a coupling sequence, the thrust mechanism 28, upon the receipt of an appropriate electrical input signal, will apply a suitable predetermined thrust force to the thrust plate member 30. Such thrust force applied the thrust plate member 30 will cause the electric coupler box member 24 to advance in a forward direction to a coupled position. When the coupling sequence is being carried out the buffer type coil springs 32 will substantially minimize and/or essentially prevent any damage occurring to the electric coupler assembly 10 in the event of an over adjustment of the limit switch stop.

On the other hand, when there is an electrical uncoupling of the passenger transit type railway cars to be accomplished the thrust force being exerted by the thrust mechanism 28 on the thrust plate member 30 must be reversed. This reversal of such thrust force on such thrust plate member 30 will result in the electric coupler box member 24 sliding in a backward direction into an electrically uncoupled position.

According to an alternative embodiment of the instant invention, there is provided a coupling mechanism for connecting the adjacently disposed ends of a pair of passenger transit type vehicles together to form a train consist. Such coupling mechanism includes a mechanical type coupling mechanism, generally designated, 20 which is secured to one end of such passenger transit type vehicle (not Shown) and a linear bearing type electric coupling mechanism, generally designated, 10. Such linear bearing type electric coupling mechanism 10 is the same as the above described linear bearing type electric coupling mechanism 20. Accordingly, such description will not be repeated here.

While a number of both presently preferred and alternative embodiments of the automatic electric coupling mechanism for a passenger transit type vehicle have been described in considerable detail above with particular reference to the drawing Figures, it should be understood that various additional modifications and/or adaptations of such invention can be readily envisioned by those persons who are skilled in the passenger transit type railway car electric coupling art without departing from the spirit and scope of the appended claims.

We claim:

1. An improved electric coupling type mechanism engageable with a mechanical type coupling mechanism disposed on one end of a passenger transit type vehicle to enable all necessary electrical connections required to operate such vehicle to be achieved, said electric coupling type mechanism comprising:

(a) an interface means engageable with both such mechanical type coupling mechanism and said electric coupling type mechanism for positioning in a first predetermined position said electric coupling type mechanism with respect to such mechanical type coupling mechanism;

(b) a first securing means engageable with each of said interface means and such mechanical type coupling mechanism for securing said interface means to such mechanical type coupling mechanism;

(c) a second securing means engageable with each of said interface means and said electric coupling type mechanism for securing said electric coupling type mechanism to said interface means;

(d) a pair of bearing shaft members;

(e) a pair of shaft support members connected to a respective one of said pair of bearing shaft members;

(f) a third securing means engageable with each of said interface means and said pair of shaft support members for securing said pair of shaft support members to said interface means in a second predetermined position;

(g) a pair of electric coupler box members;

(h) a pair of linear type bearings, a respective one of said pair of linear type bearings being secured to a predetermined portion of a respective one of said electric box members and engageable with a respective one of said bearing shaft members;

(i) a thrust plate member disposed on said linear bearing type electric coupler assembly;

(j) a pair of coil springs connected to support said thrust plate member for longitudinal movement;

(k) means engageable both said electric coupler box members and with said coil springs for connecting said coil springs to said electric coupler box member; and (l) a thrust mechanism connected to said thrust plate member for applying a predetermined thrust force to said thrust plate member during at least one of a coupling operation and an uncoupling operation.

2. An improved electric coupling type mechanism, according to claim 1, wherein said electric coupling type mechanism is a buffered linear bearing type electric coupler assembly.

3. An improved electric coupling type mechanism, according to claim 1, wherein said interface means is designed as a support plate member.

4. An improved electric coupling type mechanism, according to claim 3, wherein said first predetermined position is such that it will substantially insure a substantially central positioning of said electric coupling type mechanism with respect to such mechanical type coupling mechanism regardless of which portion of such mechanical type coupling mechanism said support plate member is engaged with.

5. An improved electric coupling type mechanism, according to claim 4, wherein said first securing means is a first removable type securing means.

6. An improved electric coupling type mechanism, according to claim 5, wherein said first removable type securing means is at least one of pins, bolts and a combination of pins and bolts.

7. An improved electric coupling type mechanism, according to claim 4, wherein said second securing means is a second removable type securing means.

8. An improved electric coupling type mechanism, according to claim 7, wherein said second removable type securing means is at least one of pins, bolts and a combination of pins and bolts.

9. An improved electric coupling type mechanism, according to claim 4, wherein said third securing means is a third removable type securing means.

10. An improved electric coupling type mechanism, according to claim 9, wherein said third removable type securing means is at least one of pins, bolts and a combination of pins and bolts.

11. An improved electric coupling type mechanism, according to claim 10, wherein said second predetermined position is a position which will ensure that said pair of shaft support members will be disposed substantially symmetrical on each side of a center of said support plate member.

12. An improved electric coupling type mechanism, according to claim 4, wherein said predetermined portion of said respective one of said pair of electric box members is a bottom portion thereof.

13. An improved electric coupling type mechanism, according to claim 12, wherein said linear type bearings are inserted onto a respective one of said bearing shaft members.

14. An improved electric coupling type mechanism, according to claim 13, wherein each respective one of said bearing shaft members includes a fender washer member disposed adjacent each end thereof.

15. An improved electric coupling type mechanism, according to claim 1, wherein said thrust mechanism is driven by one of electrical power, pneumatic power and hydraulic power.

16. An improved electric coupling type mechanism, according to claim 15, wherein said thrust mechanism is driven by electric power.

17. A coupling mechanism for connecting adjacently disposed ends of a pair of passenger transit type vehicles together to form a train consist, said coupling mechanism comprising:

(a) a mechanical type coupler secured to one end of such passenger transit type vehicle; and (b) a linear bearing type electric coupling mechanism, said linear bearing type electric coupling mechanism including;

(i) an interface means engageable with both said mechanical type coupling mechanism and said electric coupling type mechanism for positioning in a first predetermined position said electric coupling type mechanism with respect to said mechanical type coupling mechanism, (ii) a first securing means engageable with each of said interface means and said mechanical type coupling mechanism for securing said interface means to said mechanical type coupling mechanism, (iii) a second securing means engageable with each of said interface means and said electric coupling type mechanism for securing said electric coupling type mechanism to said interface means, (iv) a pair of bearing shaft members, (v) a pair of shaft support members connected to a respective one of said pair of bearing shaft members, (vi) a third securing means engageable with each of said interface means and said pair of shaft support members for securing said pair of shaft support members to said interface means in a second predetermined position, (vii) a pair of electric coupler box members, (viii) a pair of linear type bearings, a respective one of said pair of linear type bearings being secured to a predetermined portion of a respective one of said electric box members and engageable with a respective one of said bearing shaft members, (ix) a thrust plate member disposed on said linear bearing type electric coupler assembly, (x) a pair of coil springs connected to support said thrust plate member for longitudinal movement, (xi) means engageable both said electric coupler box members and with said coil springs for connecting said coil springs to said electric coupler box member, and (xii) a thrust mechanism connected to said thrust plate member for applying a predetermined thrust force to said thrust plate member during at least one of a coupling operation and an uncoupling operation.

18. A passenger transit type vehicle coupling mechanism, according to claim 17, wherein said electric coupling type mechanism is a buffered linear bearing type electric coupler assembly.

19. A passenger transit type vehicle coupling mechanism, according to claim 17, wherein said first predetermined position is such that it will substantially insure a substantially central positioning of said electric coupling type mechanism with respect to such mechanical type coupling mechanism regardless of which portion of such mechanical type coupling mechanism said support plate member is engaged with.

20. A passenger transit type vehicle coupling mechanism, according to claim 17, wherein said thrust mechanism is driven by electric power.

* * * * *